US006756859B2

(12) United States Patent
Kodim

(10) Patent No.: US 6,756,859 B2
(45) Date of Patent: Jun. 29, 2004

(54) R.F. ANTENNA SWITCH FOR USE WITH INTERNAL AND EXTERNAL ANTENNAS

(75) Inventor: Walter Kodim, Nürnberg (DE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 69 days.

(21) Appl. No.: 09/989,528

(22) Filed: Nov. 21, 2001

(65) Prior Publication Data

US 2002/0060615 A1 May 23, 2002

(30) Foreign Application Priority Data

Nov. 22, 2000 (EP) ..... 00125211

(51) Int. Cl.[7] ..... H01P 1/10; H01P 5/18
(52) U.S. Cl. ..... 333/101; 333/109; 333/136
(58) Field of Search ..... 333/101, 104, 333/109, 117, 136

(56) References Cited

U.S. PATENT DOCUMENTS

| | | | | |
|---|---|---|---|---|
| 4,150,345 A | 4/1979 | Goldman et al. | | |
| 4,626,806 A | 12/1986 | Rosar et al. | | |
| 6,225,874 B1 | 5/2001 | Kerley | ..... | 333/109 X |
| 6,483,397 B2 | 11/2002 | Catoiu | ..... | 333/117 X |

FOREIGN PATENT DOCUMENTS

| | | | | |
|---|---|---|---|---|
| EP | 0556398 A1 | 8/1993 | | |
| GB | 801062 | 9/1958 | ..... | 333/101 |
| JP | 05315803 A | 11/1993 | | |
| WO | WO88/00760 | 1/1988 | | |
| WO | WO97/23929 | 7/1997 | | |

OTHER PUBLICATIONS

Ashoka, H.: "Practical Realisation of Difficult Microstrip Line Hybrid Couplers and Power Dividers", International Microwave Symposiu,m Digest, (MTT–S), US, New York, IEEE, Jun. 1, 1992, pp. 273–276, XP000332726.

*Primary Examiner*—Benny Lee

(57) ABSTRACT

An R.F. antenna switch (102) for coupling either a high-loss port (112) or a low-loss port (114) to a common port (110) includes an unequal power splitter (104) with the high-loss port (112), the low-loss port (114), and the common port (110). The unequal power splitter (104) further has at least one high-loss path (120) coupled between the common port (110) and the high-loss port (112) and a low-loss path (122) coupled between the common port (110) and the low-loss port (114). The R.F. antenna switch (102) further comprises a switching element (106) having an input (106A) coupled to the low-loss port (114) and an output (10B) coupled to a terminating element (108). The low-loss port (114) is terminated with the characteristic impedance of the unequal power splitter (104) when the switching element (106) is switched on.

8 Claims, 8 Drawing Sheets

R.F. ANTENNA SWITCH FOR USE WITH INTERNAL AND EXTERNAL ANTENNAS

BACKGROUND OF THE INVENTION

1. Technical Field

The invention relates to the field of radio frequency (R.F.) circuits and more particularly to an R.F. antenna switch.

2. Discussion of the Prior Art

R.F. switches are commonly used in R.F. applications such as R.F. transceivers known from WO 88/00760. WO 88/00760 concerns R.F. transceivers having an R.F. antenna switch for switching an antenna path and an R.F. local oscillator switch for switching a local oscillator signal path.

The R.F. antenna switch is used to route a common antenna path to either a receiver block or a transmitter block of the R.F. transceiver. The antenna switch essentially consists of two PIN diode switching elements and a one-quarter wavelength transmission line. When the two PIN diodes are switched on, a transmitter port is connected to an antenna port through the first PIN diode and a receiver port is connected to ground through the second PIN diode. When the two PIN diodes are switched off, the transmitter port is disconnected from the antenna port and the receiver port is connected to the antenna port through the transmission line.

The R.F. local oscillator switch according to WO 88/00760 is used to route the local oscillator signal to either a mixer of the receiver block or to an exciter of the transmitter block. The local oscillator switch essentially consists of two PIN diode switching elements and an unequal power splitter in the form of a directional coupler.

The directional coupler has a primary line and a coupled line. Due to the small overall insertion loss of the primary line a receiver signal can be coupled from an input port of the primary line to an output port of the primary line with hardly any losses (low-loss path). Due to a relatively low coupling factor, however, the local oscillator signal transmitted from an input port of the coupled line to the output port of the primary line is strongly attenuated (high-loss path).

The input port of the primary line is connected to the output of a receiver front end circuit and the output port of the primary line is connected to the mixer. The input port of the coupled line is connected to both a local oscillator and an input of a first PIN diode. An output of the first PIN diode is coupled to the exciter. An output port of the coupled line is connected to both an output of a second PIN diode and a terminating element allowing termination of the output port of the coupled line with the characteristic impedance of the coupled line.

When the two PIN diodes are switched on, the output port of the coupled line is shorted and the one-quarter wavelength coupled line has an infinite impedance at the input port of the coupled line. Consequently, the local oscillator signal is routed through the second PIN diode to the exciter. When the two PIN diodes are switched off, the output port of the coupled line is terminated in its characteristic impedance. The local oscillator signal can then be routed through the coupled line and a portion of it is thus transmitted to the output port of the primary line.

The R.F. local oscillator switch according to WO 88/00760 consists of two PIN diodes and a plurality of passive components. However, the plurality of PIN diodes and passive components limits the degree to which the R.F. local oscillator switch can be miniaturized and increases the overall cost of the switch.

The R.F. local oscillator switch, which is used in addition to the above described R.F. antenna switch, is part of a mixer stage allowing to combine two signals. The R.F. local oscillator switch is thus not suited as an R.F. antenna switch for routing either one of two antenna signals to a common port or for routing an antenna signal from the common port to either one of a high-loss port and a low-loss port.

A further R.F. antenna switch is known from WO 97/23929. This R.F. antenna switch is configured as a mechanical component and arranged within a housing of a coaxial accessory connector. A standard antenna is mounted in a top port of the coaxial accessory connector. A radial port in the coaxial accessory connector can be coupled to a further antenna which activates the R.F. switch to disengage from the standard antenna contact and to engage a contact in the radial port. In this way, the R.F. signal is conducted to the further antenna, rather than to the standard antenna. When the R.F. switch is not activated by the further antenna, the R.F. signal is carried through the coaxial accessory connector to the standard antenna.

There is a need for an R.F. antenna switch which has a simple construction and which allows a higher degree of integration. There is also a need for a preferred use of such an R.F. antenna switch and for an R.F. device incorporating such an R.F. antenna switch.

SUMMARY OF THE INVENTION

The present invention satisfies these needs by providing an R.F. antenna switch for coupling a common port to either a high-loss port or a low-loss port, the R.F. antenna switch having an unequal power splitter with at least the common port, the high-loss port and the low-loss port. The unequal power splitter further comprises a high-loss path coupled between the common port and the high-loss port and a low-loss path coupled between the common port and the low-loss port. A switching element of the R.F. antenna switch has an input coupled to the low-loss port and an output coupled to a first terminating element. The low-loss port is terminated with the characteristic impedance of the low-loss path when the switching element is switched on.

When the switching element is switched on, the low-loss port has a non-reflecting, i.e., absorbing characteristic. The impedance of the terminating element is, therefore, preferably chosen such that the total impedance of all components coupled to the low-loss port including the impedance of the terminating element equals the characteristic impedance of the low-loss path.

The R.F. antenna switch according to the invention can be realized with only one switching element and few passive components. This not only reduces the cost of the R.F. antenna switch but also allows a higher degree of integration and further miniaturization of the R.F. antenna switch.

Moreover, unequal power splitters comprising e.g. transmission line structures can be realized with ceramic multilayer technology in an efficient way. Any additional components of the R.F. antenna switch like the switching element or terminating elements can remain discrete components which may be placed on top of the ceramic multilayer substrate as already practised for state of the art transmitter/receiver-switch modules. Filter structures can advantageously be realized on the same ceramic multi-layer substrate as the R.F. antenna switch. This enables further integration and cost reduction.

The R.F. antenna switch according to the invention can advantageously be used in many technical fields and above all in all kinds of transmitting and receiving applications like positioning system receivers adapted to a standard taken from the group consisting of GPS, GLONASS, BAAS, etc or mobile phones adapted to a standard taken from the group consisting of GSM 900, GSM 1800, GSM 1900, AMPS, PDC, CDMA, WCDMA, DAMPS, etc.

The R.F. antenna switch according to the invention enables to couple either a low-loss port or a high-loss port to a common port. Thus, the R.F. antenna switch allows to couple either a signal applied to the low-loss port or a signal applied to the high-loss port to the common port or to couple a signal applied to the common port either to the low-low port or the high-loss port. Preferably, the R.F. antenna switch is switched by means of changing the impedances at the individual ports of the R.F. antenna switch. Therefore, In order to couple the signal via a specific port, this specific port can be terminated with a characteristic impedance. On the other hand, in order to block a signal from being transmitted via the specific port, the specific port can be terminated with an impedance mismatch. The impedance mismatch is e.g. created by simply switching off an electrical component, like an amplifier stage coupled to the specific port, or by physically disconnecting an electrical component like an antenna coupled to the specific port.

According to a first embodiment, the R.F. antenna switch is used as an antenna switch for coupling the common port to either a first antenna connected to the low-loss port or a second antenna connected to the high-loss port. According to a second embodiment, the R.F. antenna switch is used for coupling either the low-loss port or the high-loss port to an antenna which is connected to the common port. Due to the high signal attenuation of the high-loss path, in both embodiments an active antenna can be coupled to the high-loss port.

The R.F. antenna switch of the invention may have a plurality of high-loss paths and low-loss paths. An R.F. antenna switch having such a plurality of signal paths can advantageously switch between more than two R.F. signals. Thus, novel applications of the R.F. antenna switch of the invention become feasible.

According to a preferred embodiment, the unequal power splitter is a directional coupler with a primary line and a coupled line. The common port and the low-loss port of the directional coupler are coupled to opposite ends of the primary line and the high-loss port of the directional coupler is coupled to one of the coupled lines.

In the directional coupler, microwave power propagating on the coupled line couples uni-directionally to the primary line causing microwave power to appear on it. However, due to low coupling factors only a small portion of the microwave power propagating on the coupled line is transmitted to the primary line and the remaining power continues to propagate on the coupled line. Because of the small amount of microwave power transmitted from the high-loss port of the coupled line to the common port of the primary line or vice versa, this signal path is known as high-loss path. On the other hand, due to comparatively low insertion losses between the common port and the low-loss port which connect the opposing ends of the primary line, this signal path is known as low-loss path.

The primary line and the coupled line can be realized as two closely spaced microstrip transmission lines. Each of the transmission lines preferably has a length corresponding to approximately one-quarter of the signal wavelength. Instead of transmission line structures the directional coupler may also comprise corresponding lumped component equivalents.

The directional coupler can have a isolated port arranged on an opposite end of the coupled line with regard to the high-loss port. This isolated port coupled to one end of the coupled line is preferably coupled to a further terminating element which terminates the isolated port with the characteristic impedance of the coupled line. Therefore, the isolated port has a non-reflecting characteristic for any signals or signal components propagating on the coupled line.

The isolated port coupled to the coupled line and the low-loss port coupled to the primary line can electrically be arranged on opposite sides of the directional coupler with respect to the coupling direction. This arrangement of the low-loss port and the isolated port ensures that in case of uni-directional couplers the isolated port absorbs any signal components input through the low-loss port and transmitted by the directional coupler to the isolated port. With regard to the physical arrangement of the isolated port and the low-loss port, these ports may be arranged either on the same side or on opposite sides of the directional coupler.

According to one embodiment, the R.F. antenna switch further comprises a control circuit for controlling the switching element. The switching element can be e.g. a switching transistor, a varactor diode or a PIN diode.

The control circuit may consist of one or more components and can be coupled to the switching element in many ways. The control circuit is preferably coupled to the common port or the low-loss port of the unequal power splitter.

The control circuit may have a control input terminal for inputting a control signal like a control voltage. By means of the control signal the switching element can be switched between an on position and an off position. Moreover, the control circuit may have a low-pass filter coupled between the control input terminal and the switching element. The low-pass filter ensures that R.F. signals cannot leak through the control circuit.

In many cases it is advantageous to have a supply circuit for supplying a voltage or a current to e.g. an active component which is also coupled to the coupled line. This active component can be an active antenna, an amplifier stage or a signal generator. The supply circuit is coupled to the coupled line of the directional coupler. Preferably, the supply circuit is coupled to the high-loss port or the isolated port of the directional coupler. The supply circuit can further have a supply input terminal for inputting the supply voltage. The supply circuit may also have a low-pass filter coupled between the supply input terminal and either the high-loss port or the isolated port of the directional coupler. The low-pass filter prevents R.F. signals from leaking through the supply circuit.

When the R.F. antenna switch according to the invention is implemented in an R.F. device like a mobile phone for at least one of sending and receiving an R.F. signal, this R.F. device may further comprise one or more external antenna connectors for connecting external antennas to the R.F. antenna switch. The external antenna connectors can e.g. be coupled to at least one of the high-loss port, the low-loss port and the common port of the unequal power splitter. The R.F. device can also comprise one or more antennas. These antennas are preferably either external antennas coupled to at least one of the external antenna connectors of the R.F. antenna switch or internal antennas coupled to at least one of the high-loss port, the low-loss port and the common port of the unequal power splitter. According to a preferred embodiment, the antennas of the R.F. device are designed as mobile phone antennas or positioning system antennas.

The antenna which is coupled directly, or via the external antenna connector, to the high-loss port of the unequal power splitter is preferably an active antenna or an antenna providing high gain. This is advantageous since the high-loss port of the unequal power splitter is coupled to the high-loss path so that the microwave power propagating on the high-loss path from or to the antenna is strongly attenuated.

BRIEF DESCRIPTION OF THE DRAWINGS

Further aspects and advantages of the invention will become apparent upon reading the following detailed description of preferred embodiments of the invention and upon reference to the drawings, in which.

DESCRIPTION OF THE PREFERRED EMBODIMENTS

Figure 1:
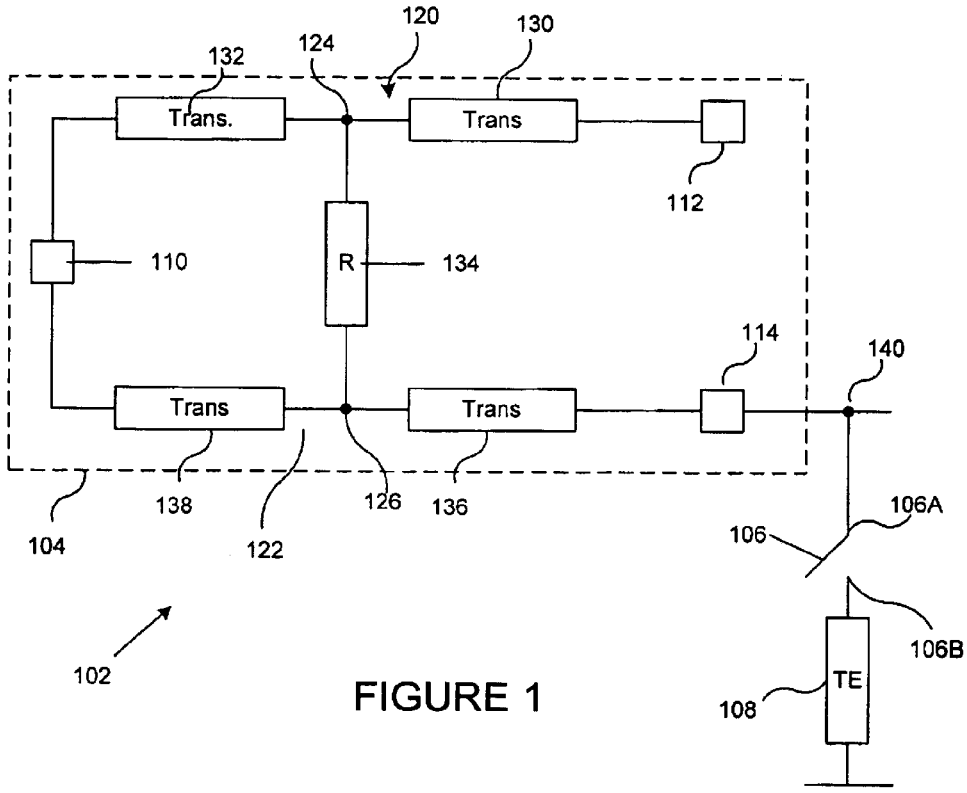
FIG. 1 is a schematic diagram of a first embodiment of an R.F. antenna switch according to the invention.

In FIG. 1 a schematic diagram of a first embodiment of an R.F. antenna switch 102 according to the invention is illustrated. The R.F. antenna switch 102 depicted in FIG. 1 consists essentially of a three-port unequal power splitter 104, a switching element 106 and a terminating element 108. The unequal power splitter 104 has a common port 110, a high-loss port 112 and a low-loss port 114. To these ports 110, 112 and 114 components like antennas, amplifier stages and signal generators may be connected.

The unequal power splitter 104 further has two nodes 124, 126. A first transmission line 130 of the unequal power splitter 104 is connected between node 124 and the high-loss port 112 and a second transmission line 132 of the unequal power splitter 104 is connected between the node 124 and the common port 110. A resistor 134 is connected between node 124 and node 126. A third transmission line 136 of the unequal power splitter 104 is connected between node 126 and the low-loss port 114 and a fourth transmission line 138 is connected between the node 126 and the common port 110. All transmission lines 130, 132, 136, 138 have approximately a one-quarter wavelength characteristic.

The dimensions of the transmission lines 130, 132, 136, 138 and the value of the resistor 134 have been chosen such that the insertion loss between the common port 110 and the high-loss port 112 of the unequal power splitter 104 is significantly higher than the insertion loss between the common port 110 and the low-loss port 114 of the unequal power splitter 104. Consequently, a high-loss path 120 having a high insertion loss is created between the common port 110 and the high-loss port 112 and a low-loss path 122 having a low insertion loss is created between the common port 110 and the low-loss port 114.

The low-loss port 114 of the unequal power splitter 104 and an input 106A of the switching element 106 are connected to a node 140. According to an embodiment not depicted in FIG. 1, additional components like a capacitor may be coupled between the low-loss port 114 and the node 140. An output 106B of the switching element 106 is connected through the terminating element 108 to ground. The impedance of the terminating element 108 has been chosen such that the overall impedance which comprises the impedance of the terminating element 108, the impedance of the switching element 106 and the impedance of further components connected to node 140 at the low-loss port 114 of the unequal power splitter 104 equals the characteristic impedance of the unequal power splitter 104. Therefore, the low-loss port 114 is non-reflectingly terminated when the switching element 106 is switched on.

Next, preferred operation modes of the R.F. antenna switch 102 depicted in FIG. 1 are described.

When the switching element 106 is switched on (mode 1 of the R.F. antenna switch 102), the terminating element 108 is connected to the low-loss port 114 of the unequal power splitter 104. The low-loss port 114 is thus terminated with the characteristic impedance of the unequal power splitter 104. A signal path (high-loss path 120) between the common port 110 and the high-loss port 112 of the unequal power splitter 104 is provided and any signals or signal components at the low-loss port 114 are absorbed in the terminating element 108. Preferably, any component like an active antenna or an amplifier stage connected to node 140 is kept in an off state or disconnected from low-loss port 114 in mode 1 of the R.F. antenna switch 102.

When the switching element 106 is switched off (mode 2 of R.F. antenna switch 102), the terminating element 108 is disconnected from the low-loss port 114 of the unequal power splitter 104 and a signal path (low-loss path) 122 between the common port 110 and the low-loss port 114 of the unequal power splitter 104 is established. Any signals or signal components propagating on the high-loss path 130 are strongly attenuated. Preferably, in mode 2 of the R.F. antenna switch 102 any device coupled to the high-loss port 112 of the unequal power splitter 104 is kept in an off state or disconnected from the high-loss port 112 to provide a mismatch for residual signal components at the high-loss port 112.

Consequently, by switching R.F. antenna switch 102 between mode 1 and mode 2 either a high-loss path 120 or a low-loss path 122 is chosen as a signal path. The R.F. antenna switch 102 depicted in FIG. 1 can thus be operated for example as a signal path selector. However, several other operation modes like e.g. a signal splitting mode can also be realized with the R.F. antenna switch 102 as will be apparent for those skilled in the art.

Figure 2:
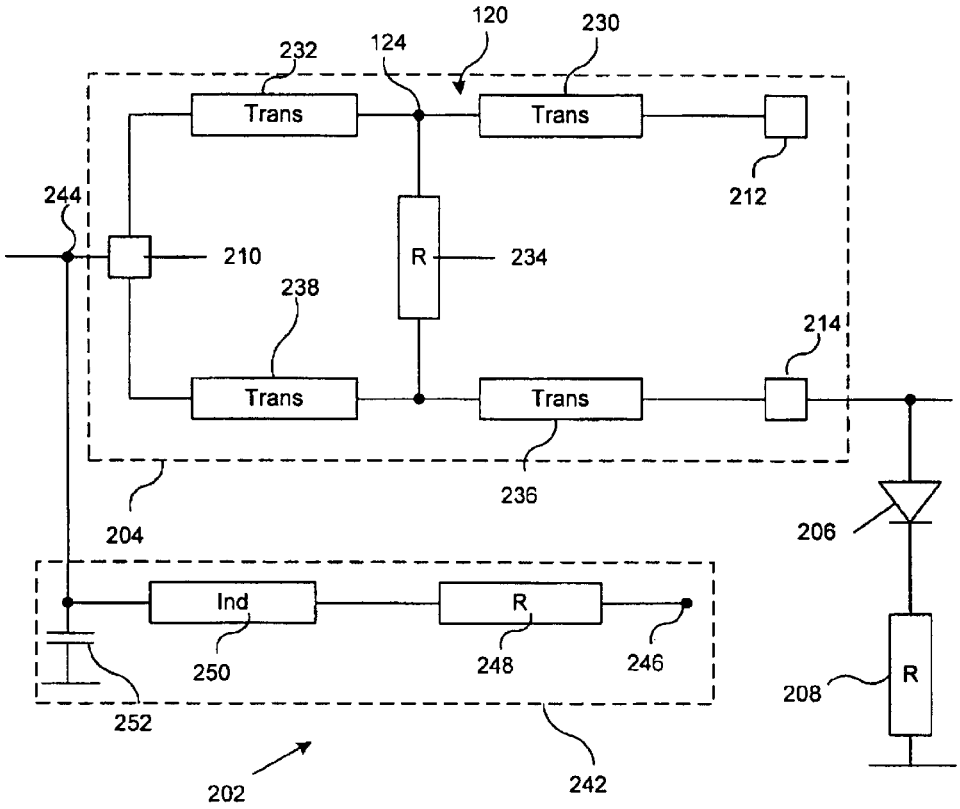
FIG. 2 is a more detailed diagram of the R.F. antenna switch depicted in FIG. 1.

FIG. 2 shows a more detailed diagram of the R.F. antenna switch depicted in FIG. 1. The R.F. antenna switch 202 according to FIG. 2 has an unequal power splitter 204 which is identical with the unequal power splitter 104 depicted in FIG. 1. The unequal power splitter 204 comprises a common port 210, a high-loss port 212, a low-loss port 214, four transmission lines 230, 232, 236, 238 and a resistor 234. The R.F. antenna switch 202 further has a PIN diode 206 as switching element and a resistor 208 as terminating element. The function of the PIN diode and the resistor 208 is the same as the function of the switching element 106 and the terminating element 108 explained in connection with FIG. 1.

A control unit 242 of the R.F. antenna switch 202 allows PIN diode 206 to be switched either on or off. The control circuit 242 is connected through a node 244 to the common port 210 of the unequal power splitter 204. The control circuit 242 has a control input terminal 246 for inputting a control signal by applying a control voltage to the control input terminal. The control input terminal 242 is connected through a resistor 248 and a low-pass filter consisting of an inductor 250 and a capacitor 252 to the node 244.

When a DC control voltage is applied to the control input terminal 246, a corresponding DC current will flow through PIN diode 206 and the PIN diode will be switched on (mode 1 of R.F. antenna switch 202). In absence of a control voltage at the control input terminal 246, i.e. when the control input terminal 246 is floating or grounded, the PIN diode 206 is in an off state (mode 2 of R.F. antenna switch 202). The operation of the R.F. antenna switch 202 depicted in FIG. 2 is identical with the operation of the R.F. antenna switch 102 depicted in FIG. 1.

Figure 3:
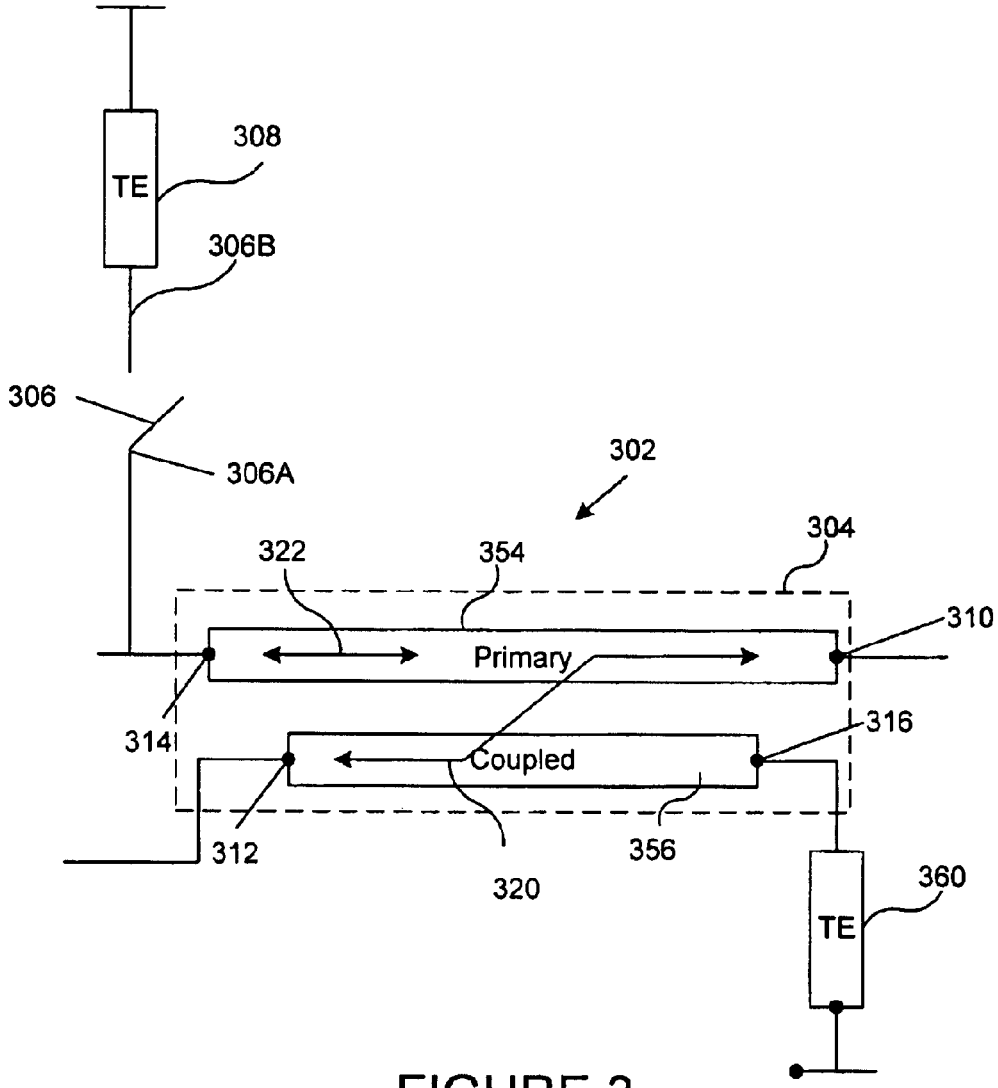
FIG. 3 is a schematic diagram of a second embodiment of an R.F. antenna switch according to the invention.

In FIG. 3 a second embodiment of an R.F. antenna switch 302 according to the invention is illustrated. The R.F. antenna switch 302 depicted in FIG. 3 essentially consists of an unequal power splitter 304, a switching element 306 and two terminating elements 308, 360. The unequal power splitter of the R.F. antenna switch 302 is a four-port directional coupler 304 having a primary line 354 and a coupled line 356. Both the primary line 354 and the coupled line 356 are transmission lines having approximately a one-quarter wavelength characteristic.

The primary line 354 has two opposing ends configured as common port 310 and low-loss port 314 of the directional coupler 304. The coupled line 356 also has two opposing ends configured as high-loss port 312 and isolated port 316 of the directional coupler 304. Due to the typically small insertion losses of the primary line 354 between the common port 310 and the low-loss port 314 of the directional coupler 304, the signal path between the common port 310 and the low-loss port 314 represents the low-loss path 322 of the R.F. antenna switch 302. Due to the comparatively small portion of microwave energy which can be transmitted from the common port 310 to the high-loss port 312 of the directional coupler 304 and vice versa, the signal path between the common port 310 and the high-loss port 312 represents the high-loss path 320 of the R.F. antenna switch 302.

The operation mode of the R.F. antenna switch 302 depicted in FIG. 3 is selected by means of the switching element 306. An input 306A of the switching element 306 is connected through a node 340 to the low-loss port 314 of the directional coupler 304. An output 306B of the switching element 306 is connected via the terminating element 308 to ground. The impedance of the terminating element 308 has been chosen such that the overall impedance at the low-loss port 314 which comprises the impedance of the terminating element 308, the impedance of the switching element 306 and the impedance of any further component connected to node 340 equals the characteristic impedance of the primary line 354.

The R.F. antenna switch 302 has a further terminating element 360 which is connected between the isolated port 316 of the directional coupler 304 and ground. The impedance of the terminating elements 360 has been chosen such that it equals the impedance of the coupled line 356. Consequently, the coupled line 356 is always terminated at the isolated port 316 in a non-reflecting manner. Any signal or signal component that is output through the isolated port 316 of the directional coupler 304, e.g. the portion of a signal input to the coupled line 356 through the high-loss port 312 and not transmitted to the primary line 354, is absorbed in the terminating element 360. Likewise, any signal component transmitted from the primary line 354 to the coupled line 356 and output through the isolated port 316 is absorbed in the terminating element 360.

The operation of the R.F. antenna switch 302 depicted in FIG. 3 is essentially the same as the operation of the R.F. antenna switch 102 depicted in FIG. 1. When the switching element 312 is switched on (mode 1 of R.F. antenna switch 302) the high-loss path 320 is the main signal path and when the switching element 306 is switched off (mode 2 of the R.F. antenna switch 302) the low-loss path 322 is the main signal path.

With respect to a coupling direction along the low-loss path 322 or the high-loss path 320, the common port 310 connectable to terminating elements 308 and the isolated port 316 are electrically arranged on opposite sides of the directional coupler 304.

In FIGS. 4 to 7 four different applications for the R.F. antenna switches illustrated in FIGS. 1 to 3 are schematically depicted. In these applications the R.F. antenna switch is preferrably used as an antenna switch. If the R.F. antenna switches 102 and 202 having a three-port unequal power splitter depicted in FIGS. 1 and 2, respectively, are used in these applications, the terminating element terminating the isolated port of the directional coupler depicted in FIGS. 4 and 5 can be omitted.

Figure 4:
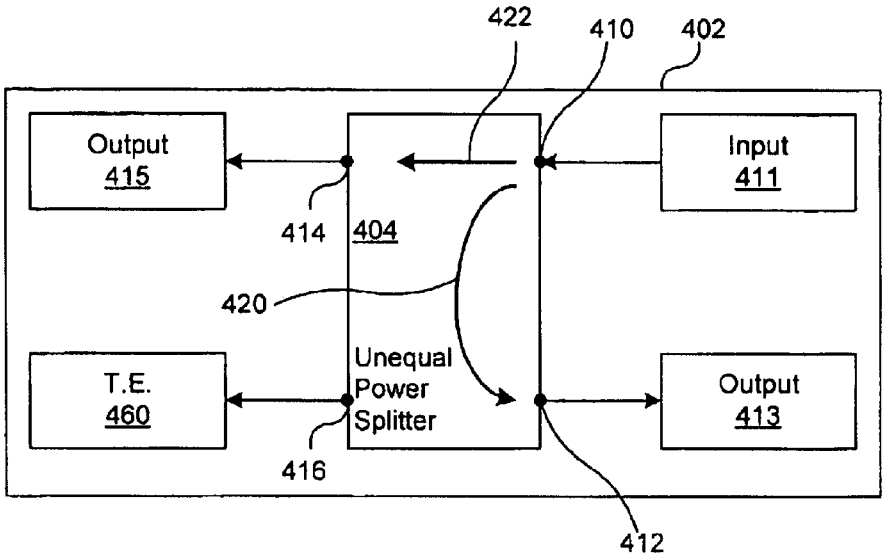
FIG. 4 is a block diagram showing a first application of the R.F. antenna switch depicted in one of FIGS. 1 to 3.

FIG. 4 shows a first embodiment of an R.F. antenna switch 402 according to the invention with an unequal power splitter 404 in a transmitter circuit. The switching element and the terminating element connected to the switching element are not shown.

The R.F. antenna switch 402 has a transmitter input terminal 411 connected to a common port 410 of the unequal power splitter 404. The common port 410 is thus used as a common input port. A first output terminal 413 is connected to a high-loss port 412 of the unequal power splitter 404. The first output terminal 413 is thus connected through a high-loss path 420 to the common port 410. The high-loss port 412 of the unequal power splitter 404 is used as a first output port. A second output terminal 415 of the R.F. antenna switch 402 is connected to a low-loss port 414 of the unequal power splitter 404. The second output terminal 415 is therefore coupled through a low-loss path 422 to the common port 410. The low-loss port 414 is thus used as a second output port. If the unequal power splitter 404 is realized as a directional coupler, the isolated port 416 is connected to a terminating element 460.

If the R.F. antenna switch 402 depicted in FIG. 4 is incorporated in e.g. an R.F. transmitter, an internal antenna of the R.F. transmitter may be connected to the second output terminal 415 and an external antenna may be connected to the first output terminal 413. Since a signal propagating on the high-loss path 420 from the input terminal 411 to the first output terminal 415 is strongly attenuated, the external antenna is preferably an active antenna which compensates for the losses along the high-loss path 420.

When the switching element of the R.F. antenna switch 402 as well as the active antenna connected to the first output terminal 413 are switched on and when an impedance mismatch is created at the second output port 414 (mode 1 of R.F. antenna switch 402), a signal path (high-loss path 420) between the common input port 410 and the first output port 412 is established. On the other hand, when in mode 2 the switching element of the R.F. antenna switch 402 and the active antenna are switched off, i.e., when an impedance mismatch is created at the first output port 412, a signal path (low-loss path 422) between the common input port 410 and the second output port 414 is established.

Figure 5:
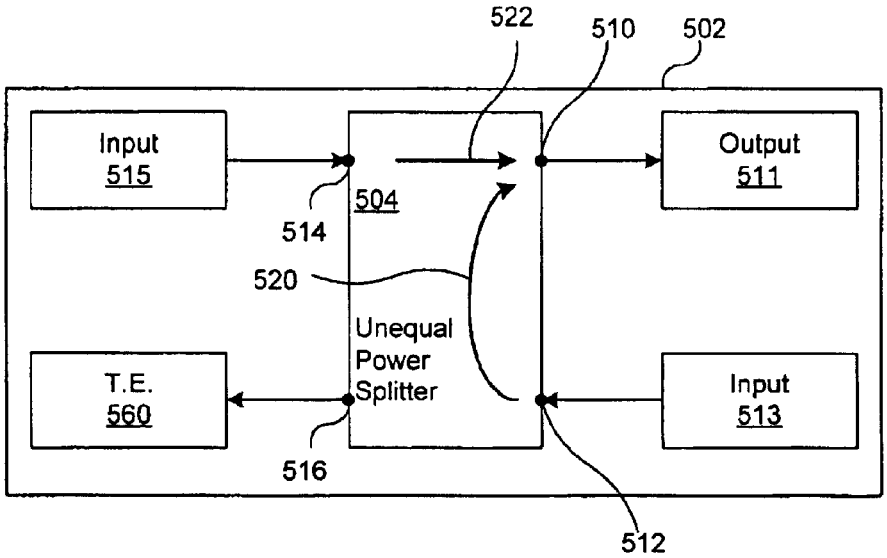
FIG. 5 is a block diagram showing a second application of the R.F. antenna switch depicted in one of FIGS. 1 to 3.

FIG. 5 shows a second application of an R.F. antenna switch 502 according to the invention with an unequal power splitter 504 in a receiver circuit. Again, the switching element and the terminating element connected to the switching element are not shown.

The R.F. antenna switch 502 has a receiver output terminal 511 connected to a common port 510 of the unequal power splitter 504. The common port 510 is thus used as a common output port. A first input terminal 513 of the R.F. antenna switch 502 is connected to a high-loss port 512 of the unequal power splitter 504. The first input terminal 513 is therefore coupled through a high-loss path 520 to the common port 510. The high-loss port 512 is thus used as a first input port. A second input terminal 515 of the R.F. antenna switch 502 is connected to a low-loss port 514 of the unequal power splitter 504. The second input terminal 515 is thus coupled through a low-loss path 522 to the common port 510. The low-loss port 514 is thus used as a second input port. In case the unequal power splitter 504 is realized as a directional coupler, an isolated port 516 of the directional coupler is connected to a terminating element 560.

If the R.F. antenna switch 502 is incorporated in e.g. a R.F. receiver, an internal antenna can be connected to the second input terminal 515 and an external antenna can be connected to the first input terminal 513. Since the signal propagating on the high-loss path 520 from the first input port 512 to the common output port 510 is strongly attenuated, the external antenna is preferably an active antenna.

When the switching element of the R.F. antenna switch 502 is switched on and the active antenna connected to the first input terminal 513 is likewise switched on and when an impedance mismatch is created at the second input port 514 (mode 1 of the R.F. antenna switch 502), a signal path (high-loss path 520) between the first input port 512 and the common output port 510 of the unequal power splitter 504 is established. On the other hand, when the switching element of the R.F. antenna switch 502 is switched off and the external active antenna connected to the first input terminal 513 is likewise switched off (mode 2 of the R.F. antenna switch 502), a signal path (low-loss path 522) between the second input port 514 and the common output port 510 of the unequal power splitter 504 is established.

Of course, the embodiments of an R.F. antenna switch described above with reference to FIGS. 4 and 5 can also be used for coupling either one of two output signals applied to the high-loss port and the low-loss port, respectively, to a single internal or external antenna coupled to the common port or for routing a signal received from this antenna to either one of the high-loss port and the low-loss port. The switching can be performed by changing the impedances at the high-loss port and the low-loss port. Depending on which of these two ports is terminated with an impedance mismatch and which of these two ports is terminated with a characteristic impedance, either the high-loss path or the low-loss path is activated.

Figure 6:
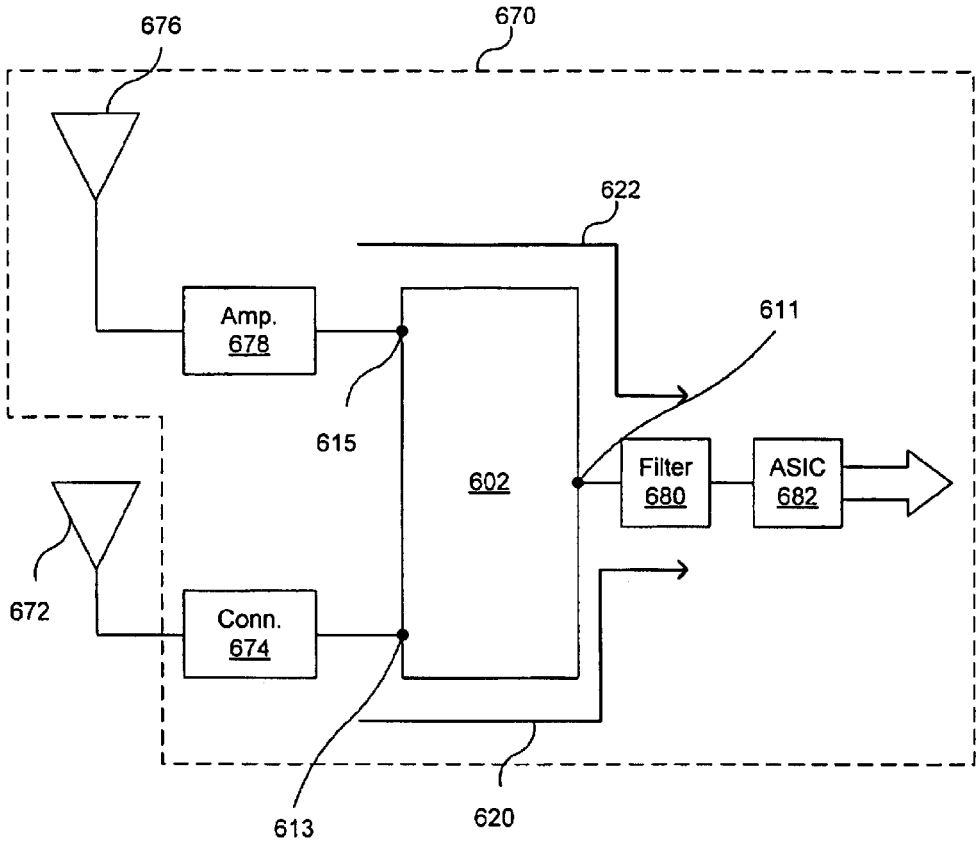
FIG. 6 is a block diagram showing a third application of the R.F. antenna switch depicted in one of FIGS. 1 to 3.

FIG. 6 shows a third application of an R.F. antenna switch 602 in a GPS receiver 670. The R.F. antenna switch 602 can be identical with the R.F. antenna switch 502 depicted in FIG. 5.

The R.F. antenna switch 602 has a first input terminal 613, a second input terminal 615 and a common output terminal 611. Further components of the R.F. antenna switch 602 like a switching element or terminating elements are not shown.

In a GPS system a minimum number of four satellites are required to calculate latitude, longitude and elevation of the GPS receiver 670. The power level of a GPS signal seen on the ground is very low, typically in the range of about −160 dBW. This power level is given under the condition of free line of sight. Any additional attenuation due to obstacles along the signal path from the satellites to the GPS receiver 670 will reduce the received signal level which typically results in a reduced number of satellites or no satellites received.

In order to overcome the problems resulting from additional signal attenuation, the GPS receiver 670 depicted in FIG. 6 comprises an internal antenna 676 and an external active antenna 672 may be connected to the GPS receiver 670 through an external antenna connector 674 of the GPS receiver 670. In the presence of additional attenuation which is for example given if the GPS receiver is e.g. used inside vehicles, the internal antenna 676 of the GPS receiver 670 is disabled and the external active antenna 672 is connected. By means of the R.F. antenna switch 602 the GPS receiver 670 can be switched between the internal antenna 676 and the external active antenna 672.

A GPS signal picked up by the external active antenna 672 is input through the external antenna connector 674 to the first input terminal 613 of the R.F. antenna switch 602. A GPS signal picked up by the internal antenna 676 is amplified by a low noise GPS amplifier 678 and input through the second input terminal to the R.F. antenna switch 602.

Depending on the state of the switching element of the R.F. antenna switch 602, either the signal picked up by the internal antenna 676 is routed along a low-loss path 622 or the GPS signal picked up by the external active antenna 672 is routed along a high-loss path 620 to the common output terminal 611 of the R.F. antenna switch 602.

The external active antenna 672 normally provides higher gain than is actually needed for the compensation of losses in a cable arranged between the external active antenna 672 and the external antenna connector 674. In spite of the high losses along the high-loss path 620 it is thus ensured that a sufficient portion of the signal power provided by the external active antenna 672 is output through the common output terminal 611.

The GPS signal output through the common output terminal 611 of the R.F. antenna switch 602 is input to a 1.575 MHz band-pass filter 680 and the filtered GPS signal output by the band-pass filter 680 is input to an amplifier which is part of a GPS radio ASIC 682. The signal which is output from the GPS radio ASIC 682 may be output via an interface (not shown in FIG. 6) and further processed. The band-pass filter 680 can advantageously be integrated on the same substrate as the R.F. antenna switch 602.

Figure 7:
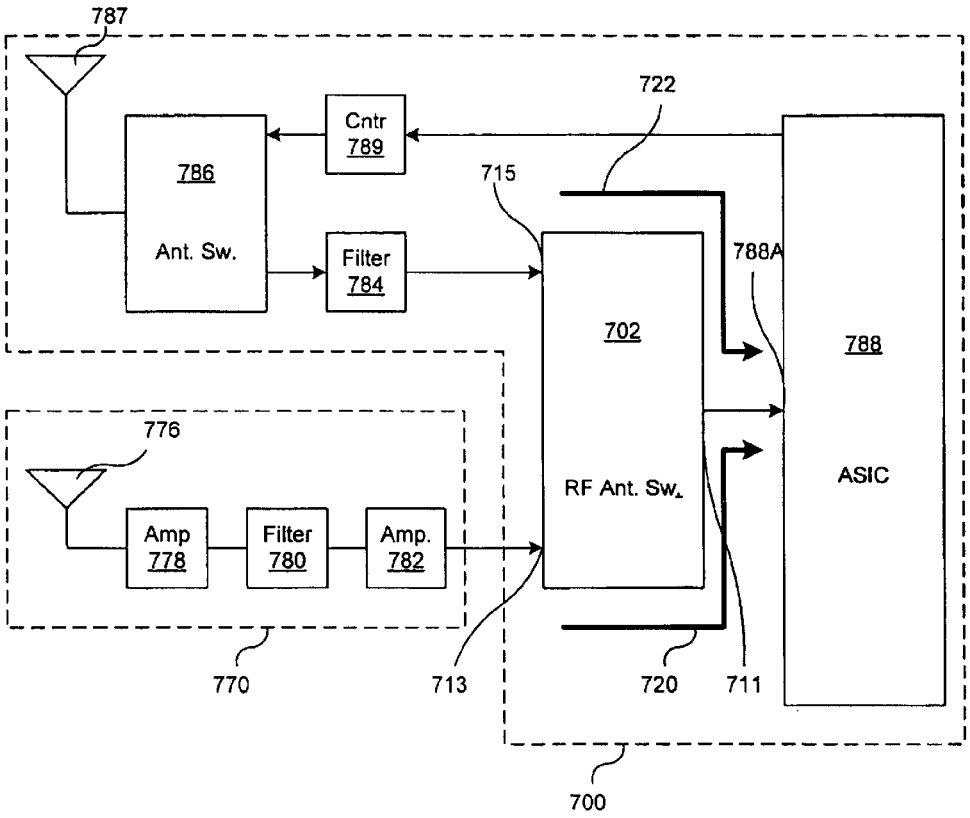
FIG. 7 is a block diagram showing a fourth application of the R.F. antenna switch depicted in one of FIGS. 1 to 3.

FIG. 7 shows a fourth application of an R.F. antenna switch 702 as depicted e.g. in FIG. 5 in a mobile phone 700. The R.F. antenna switch 702 has a common output terminal 711, a first input terminal 713 and a second input terminal 715. Again, components like the switching element or terminating elements of the R.F. antenna switch 702 are not shown.

The mobile phone 700 can be connected to an external GPS front end circuit 770. Alternatively, the mobile phone 700 can have an internal GPS front end circuit not depicted in FIG. 7.

According to the embodiment depicted in FIG. 7, the external GPS front end circuit 770 has an external or internal GPS antenna 776, a low noise amplifier 778, a 1.575 MHz band-pass filter 780 and a GPS amplifier 782. According to a different embodiment, the GPS front end circuit 770 shown in FIG. 7 is replaced by the GPS receiver 670 depicted in FIG. 6.

The GPS front end circuit 770 depicted in FIG. 7 is connected to the first input terminal 713 of the R.F. antenna switch 702. The second input terminal 715 of the R.F. antenna switch 702 is connected to the output of a band-pass filter 784 and the input of the band-pass filter 784 is connected to a transmitter/receiver antenna switch 786 as e.g. known from WO88/00760 and as previously discussed.

In a receiving state of the transmitter/receiver antenna switch 786, a signal picked up by a mobile phone antenna 787 can be input through the band-pass filter 784 to the second input terminal 715 of the R.F. antenna switch 702. In a transmitting state of the transmitter/receiver antenna switch 786, a signal output from a multi-band radio ASIC 788 can be routed through power amplifier and control circuits 789 to the mobile phone antenna 787.

Depending on the state of a switching element of the R.F. antenna switch 702, either a GPS signal picked up by the GPS antenna 776 is routed along a high-loss path 720 or a mobile phone signal picked up by the mobile phone antenna 787 is routed along a low-loss path 722 to an input 788A of the multi-band radio ASIC 788.

Figure 8:
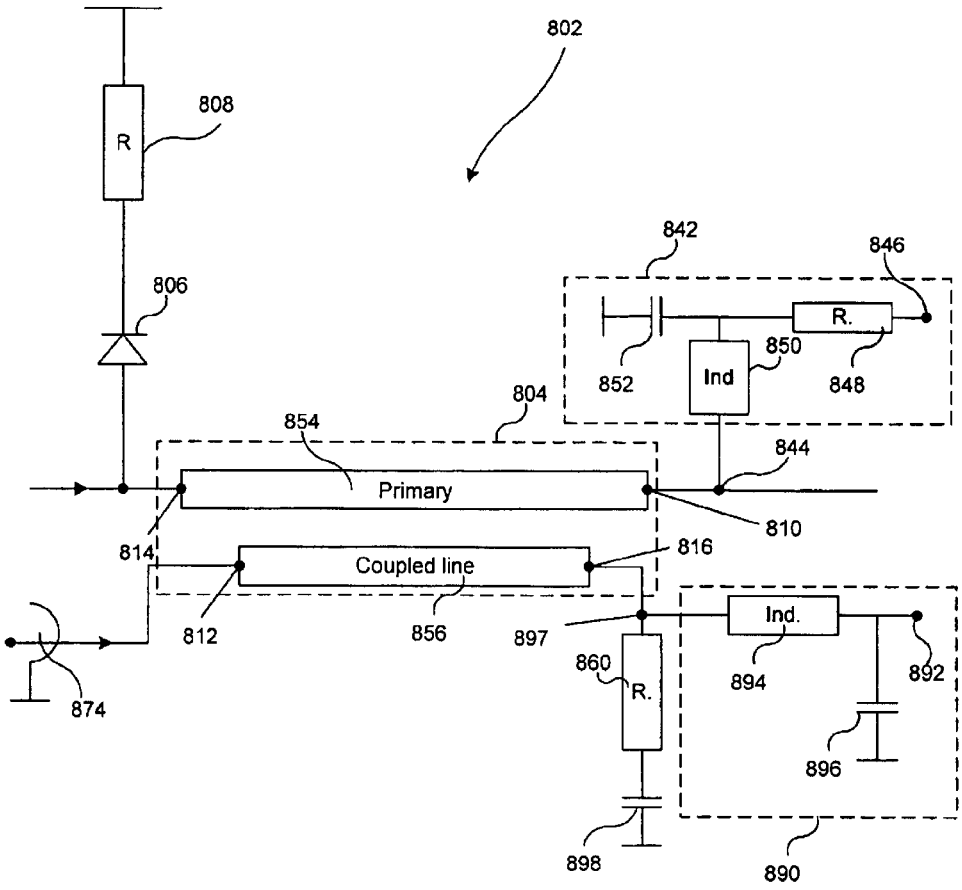
FIG. 8 is a more detailed diagram of the R.F. antenna switch depicted in FIG. 3.

FIG. 8 shows a more detailed diagram of the R.F. antenna switch depicted In FIG. 3. The R.F. antenna switch is configured e.g. for the GPS receiver application shown in FIG. 6 and has a directional coupler 804 which is identical with the directional coupler 304 depicted in FIG. 3. The directional coupler 804 has a common port 810, a primary line 854, a coupled line 856, a high-loss port 812, a low-loss port 814 and an isolated port 816. The R.F. antenna switch further has a PIN diode 806 as switching element and two resistors 808, 860 as terminating elements. The function of the PIN diode 806 and the resistors 808, 660 is the same as function of the switching element 306 and the terminating elements 308, 360 depicted in FIG. 3, respectively.

A control circuit 842 of the R.F. antenna switch 802 allows to switch PIN diode 806 either on or off. The control circuit 842 is connected through a node 844 to the common port 810. The control circuit 842 has a control input terminal 846 for inputting a control signal. The control signal may be a control voltage. The control input terminal 846 is connected through a resistor 848 and a low-pass filter consisting of an inductor 850 and a capacitor 852 to the node 844. The function of the control circuit 842 is the same as the function of the control circuit 242 depicted in FIG. 2.

A supply circuit 890 of the R.F. antenna switch 802 allows to supply a voltage through the coupled line 856 to an active component coupled to the coupled line 856. The active component can be an external active antenna connected to an external antenna connector 874 which is coupled to the high-loss port 812 of the directional coupler 804.

The supply circuit 890 is connected through a node 891 to the isolated port 816 and a resistor 808 which acts as terminating element. A capacitor 898 prevents any DC current through resistor 860. The supply circuit 890 has a supply input terminal 892 for inputting a supply voltage. The supply input terminal 892 is connected through a low-pass filter consisting of an inductor 894 and a capacitor 896 to the node 891. The low-pass filter prevents any R.F. signal components from leaking through the supply circuit 890.

It should be noted that there is no inherent DC path between the external antenna connector 874 and the common port 810 of the directional coupler 804. Consequently, the supply circuit 894 remains DC decoupled from any R.F. circuits connected to the common port 810 of the directional coupler 804.

Figure 9:
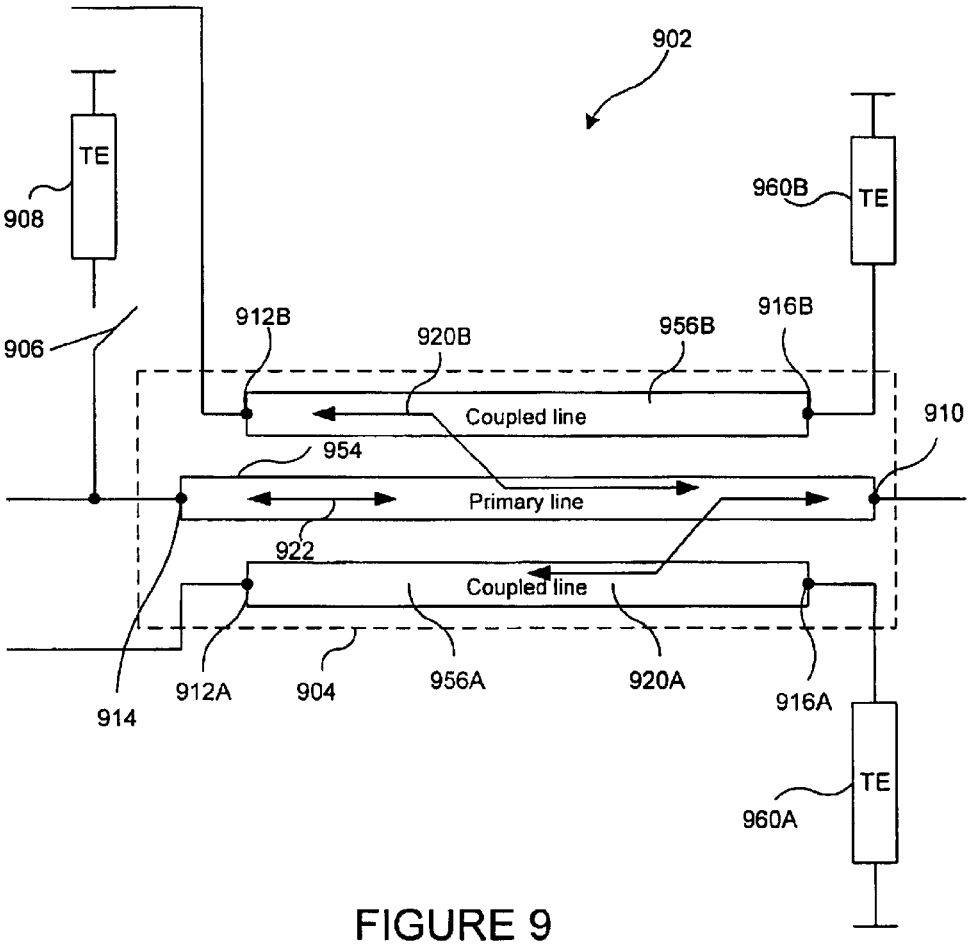
FIG. 9 is a schematic diagram of a third embodiment of the invention.

In FIG. 9 a schematic diagram of a third embodiment of an R.F. antenna switch 902 according to the invention is depicted. The R.F. antenna switch 902 depicted in FIG. 9 is essentially identical with the R.F. antenna switch 302 depicted in FIG. 3 in that the R.F. antenna switch 902 also comprises a primary line 954 coupled between a common port 910 and a low-loss port 914 of a directional coupler 904 and in that a terminating element 908 can be connected through a switching element 906 to the low-loss port 914. However, contrary to the R.F. antenna switch depicted in FIG. 3, the R.F. antenna switch 902 depicted in FIG. 9 has not a single coupled line but a first coupled line 956A and a second coupled line 956B.

Each of the two coupled lines 956A and 956B has high-loss ports 912A, 912B and isolated ports 916A and 916B at opposing ends thereof. Every isolated port 916A, 916B is terminated with a terminating element 960A, 960B.

In a first mode of the R.F. antenna switch 902, the switching element 906 is switched off and any components like active antennas connected to the high-loss ports 912A, 912B of coupled lines 956A, 956B are also switched off. Consequently, a signal path (low-loss path 922) between the common port 910 and the low-loss port 914 of the directional coupler 904 is established.

In a second mode of the R.F. antenna switch 902, the switching element 906 and the component connected to the high-loss port 912A are switched on and the component connected to the high-loss port 912B is switched off. Consequently, a signal path (high-loss path 920A) between the common port 910 and the high-loss port 912A of the directional coupler 904 is established.

In a third mode of the R.F. antenna switch 902, the switching element 902 and the component connected to the high-loss port 912B are switched on and the component connected to the high-loss port 912A is switched off. Consequently, a signal path (high-loss path 920B) between the common port 910 and the high-loss port 912B of the directional coupler 904 is established.

What is claimed is:

1. An R.F. device for at least one of sending and receiving an R.F. signal, the R.F. device having an R.F. antenna switch, the R.F. antenna switch comprising:

an unequal power splitter with
- a common port, a high-loss port and a low-loss port,
- a high-loss path coupled between the common port and the high-loss Port, and
- a low-loss path coupled between the common port and the low-loss port;
- a first antenna, the first antenna being an internal antenna coupled to the low-loss port;

a switching element having
- an input coupled to the low-loss port, and
- an output; and a first terminating element coupled to the output of the switching element, wherein the low-loss port is terminated with a characteristic impedance of the unequal power splitter when the switching element is switched on.

2. The R.F. device according to claim 1, wherein the first antenna is a positioning system antenna or a mobile phone antenna.

3. The R.F. device according to claim 1, further comprising a first external antenna connector coupled to the high-loss port.

4. The R.F. device according to claim 1, further comprising a second external antenna connector coupled to the high-loss port.

5. The R.F. device according to claim 4, further comprising a second antenna, the second antenna being an external antenna coupled to the second external antenna connector.

6. The R.F. device according to claim 5, wherein the second antenna is an active antenna.

7. The R.F. device according to claim 5, wherein the second antenna is a positioning system antenna or a mobile phone antenna.

8. The R.F. device according to claim 1, wherein the R.F. device is a mobile phone.

* * * * *